US010622136B2

(12) United States Patent
Calanca, Jr. et al.

(10) Patent No.: US 10,622,136 B2
(45) Date of Patent: Apr. 14, 2020

(54) BALANCED-TO-UNBALANCED (BALUN) TRANSFORMER

(71) Applicant: ARM LTD, Cambridge (GB)

(72) Inventors: Neil Leslie Calanca, Jr., Coral Springs, FL (US); Douglas Robl, Fort Lauderdale, FL (US)

(73) Assignee: ARM LTD, Cambridge (GB)

( * ) Notice: Subject to any disclaimer, the term of this patent is extended or adjusted under 35 U.S.C. 154(b) by 159 days.

(21) Appl. No.: 15/794,377

(22) Filed: Oct. 26, 2017

(65) Prior Publication Data

US 2019/0131054 A1 May 2, 2019

(51) Int. Cl.

*H01F 27/28* (2006.01)
*H01F 27/29* (2006.01)
*H01F 41/04* (2006.01)

(52) U.S. Cl.

CPC ..... *H01F 27/2804* (2013.01); *H01F 27/29* (2013.01); *H01F 41/041* (2013.01); *H01F 2027/2809* (2013.01); *H01F 2027/2819* (2013.01)

(58) Field of Classification Search

CPC ..... H01F 27/2804; H01F 2027/2809; H01F 27/29; H03H 7/42
USPC ..... 336/200, 232; 257/531
See application file for complete search history.

(56) References Cited

U.S. PATENT DOCUMENTS 6,476,704 B2 11/2002 Goff
6,577,219 B2 * 6/2003 Visser ..... H01F 17/0006 336/180
7,253,712 B1 8/2007 Papananos
2008/0042792 A1 2/2008 Chiu
2008/0284552 A1 * 11/2008 Lim ..... H01F 17/0006 336/200
2009/0066457 A1 * 3/2009 Uchida ..... H01F 27/2804 336/188

(Continued)

FOREIGN PATENT DOCUMENTS

JP 08078253 A * 3/1996

OTHER PUBLICATIONS

Govind, Vinu, "Design of baluns and low noise amplifiers in integrated mixed-signal organic substrates," PhD Dissertation, Georgia Institute of Technology, Aug. 2005.

(Continued)

*Primary Examiner* — Tszfung J Chan
(74) *Attorney, Agent, or Firm* — Leveque IP Law, P.C.

(57) ABSTRACT

A balanced-to-unbalanced (balun) transformer may include two metal layers on a substrate, a first winding following a first winding path, and a second winding following a second winding path, where each winding is formed in one or more of the two metal layers. The winding paths may include winding segments each disposed around a central axis of the balun transformer, where connectors join adjacent winding segments such that the winding paths are continuous between ends of the windings. The second winding path may be interwoven with, but independent from, the first winding path to form a resultant pattern that is substantially symmetrical. The second winding may include a number, n, of sub-windings, where n>1 such that a resultant number of winding segments of the second winding is greater than a resultant number of winding segments of the first winding by a factor of n.

13 Claims, 13 Drawing Sheets

(56) References Cited

U.S. PATENT DOCUMENTS

| | | | | |
|---|---|---|---|---|
| 2009/0066461 | A1* | 3/2009 | Ezzeddine | H01F 17/0013 336/200 |
| 2009/0284339 | A1 | 11/2009 | Choi et al. | |
| 2010/0164667 | A1* | 7/2010 | Ho-Hsiang | H01F 17/0006 336/137 |
| 2017/0201223 | A1 | 7/2017 | Kboush | |
| 2018/0123550 | A1* | 5/2018 | Wang | H03H 7/42 |

OTHER PUBLICATIONS

Joregensen, Doug, Marki, Christopher, "Balun basics primer," www.markimicrowave.com/assets/appnotes/balun_basics_primer.pdf, Marki Microwave, 2014.

* cited by examiner

BALANCED-TO-UNBALANCED (BALUN) TRANSFORMER

BACKGROUND

In general, transformers include electric devices that transfer electric energy from one circuit to another circuit (or multiple circuits) to increase (i.e., "step-up") or decrease (i.e., "step-down") voltage. The transfer of energy may be accomplished through electromagnetic mutual induction, i.e., where time-varying current through a primary conductor produces a time-varying magnetic flux through a secondary conductor. As a result of Faraday's law of induction, the changing flux induces an electromotive force in the secondary conductor that gives rise to a current. The voltage in the secondary conductor is typically provided by the ratio of the number of windings of the secondary conductor relative to the number of windings in the primary conductor multiplied by the voltage of the primary conductor—where this ratio is often referred to as a "turns ratio." In general, if the turns ratio of secondary to primary is greater than one, the result is a step-up transformer, and if the turns ratio of secondary to primary is less than one, the result is a step-down transformer.

A balanced-to-unbalanced transformer, which is also referred to in the art and herein as a "balun" transformer, is a device used for matching an unbalanced line to a balanced load. A common type of a balun transformer is a flux-coupled balun transformer, which is created by winding two separate wires around a magnetic core, and grounding one side of the primary winding. This creates an unbalanced condition on the primary side, and a balanced condition on the secondary side. In addition, the secondary side can have an arbitrary ratio of turns relative to the primary side (i.e., the turns ratio of n:1), creating an impedance ratio. The flux-coupled balun transformer will induce an alternating current (AC) voltage in the secondary of n times the voltage in the primary, while the current will be n times smaller than in the primary, giving an output impedance of $n^2$, where n is the ratio of turns in the secondary to turns in the primary.

Thus, balun transformers may be used to change impedance levels between stages while maintaining direct current (DC) isolation between the stages of a differential circuit. Balun transformers may also or instead be used in transmitters, where they can provide signal isolation between local oscillators and radio frequency (RF) and intermediate frequency (IF) sections of a balanced upconverter, or coupling output stages of a push-pull power amplifier. Other applications for balun transformers may include discriminators, phase detectors, antenna feeds, and the like.

As stated above, the inductors of a transformer, such as a balun transformer, may be wound around a core, directly impacting the mutual inductance between the primary and secondary inductors, and therefore the performance of the transformer. Balun transformers may be formed by placing primary and secondary windings within metal layers of a substrate (e.g., a gallium arsenide substrate)—e.g., the windings may be formed by placing planar metal traces in the substrate. It may be advantageous to provide a substantially symmetrical balun transformer with as few metal layers as possible, as this can reduce manufacturing complexity, size, and cost. Further, a high degree of electrical symmetry may help maintain circuit isolation, and provide improved broadband frequency response. However, certain geometries give rise to substantial inter-winding capacitance, which can limit the operating bandwidth of a device. Also, the center tap in balun transformers is often disposed at an undesirable location, resulting in an asymmetric geometry, the addition of metal layers, or additional direct current (DC) voltage loss due to higher resistance. There remains a need for improved balun transformers.

BRIEF DESCRIPTION OF THE DRAWINGS

The accompanying drawings provide visual representations which will be used to more fully describe various representative embodiments and can be used by those skilled in the art to better understand the representative embodiments disclosed and their inherent advantages. The drawings are not necessarily to scale, emphasis instead being placed upon illustrating the principles of the devices, systems, and methods described herein. In these drawings, like reference numerals may identify corresponding elements.

DETAILED DESCRIPTION

Figure 2:
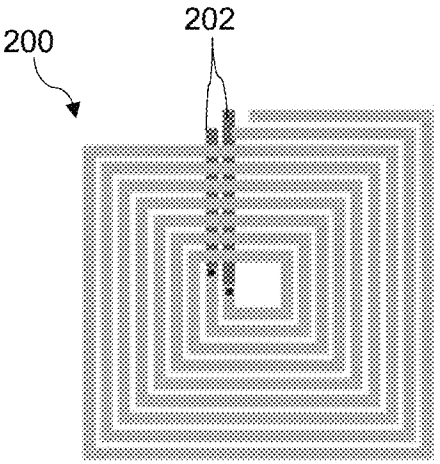
FIGS. 1-3 illustrate balun transformers.

The various methods, systems, apparatuses, and devices described herein generally provide for a balanced-to-unbalanced (balun) transformer.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals may be used to describe the same, similar or corresponding parts in the several views of the drawings.

In this document, relational terms such as first and second, top and bottom, and the like may be used solely to distinguish one entity or action from another entity or action without necessarily requiring or implying any actual such relationship or order between such entities or actions. The terms "comprises," "comprising," "includes," "including,"

"has," "having," or any other variations thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Reference throughout this document to "one embodiment," "certain embodiments," "an embodiment," "implementation(s)," "aspect(s)," or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C." An exception to this definition will occur only when a combination of elements, functions, steps or acts are in some way inherently mutually exclusive. Also, grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

All documents mentioned herein are hereby incorporated by reference in their entirety. References to items in the singular should be understood to include items in the plural, and vice versa, unless explicitly stated otherwise or clear from the text.

Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

In the following description, it is understood that terms such as "first," "second," "top," "bottom," "up," "down," "above," "below," and the like, are words of convenience and are not to be construed as limiting terms. Also, the terms apparatus and device may be used interchangeably in this text.

In general, the devices, systems, and methods described herein may be configured for, and may include, a balun transformer. As described herein, a balun transformer may include a device that joins a balanced line (one that has two conductors, with equal currents in opposite directions, such as a twisted pair cable) to an unbalanced line (one that has just one conductor and a ground, such as a coaxial cable). Thus, a balun transformer may be used to convert an unbalanced signal to a balanced signal or vice-versa, where baluns can isolate a transmission line and provide a balanced output.

Figure 3:
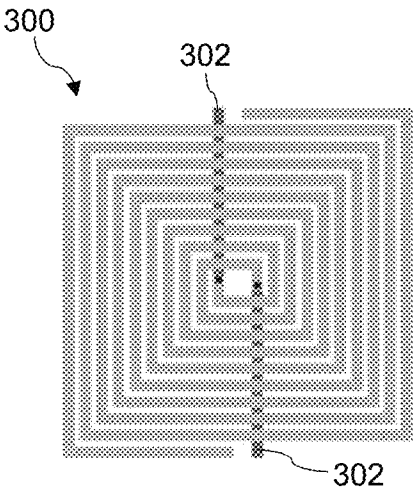
Figure 1:
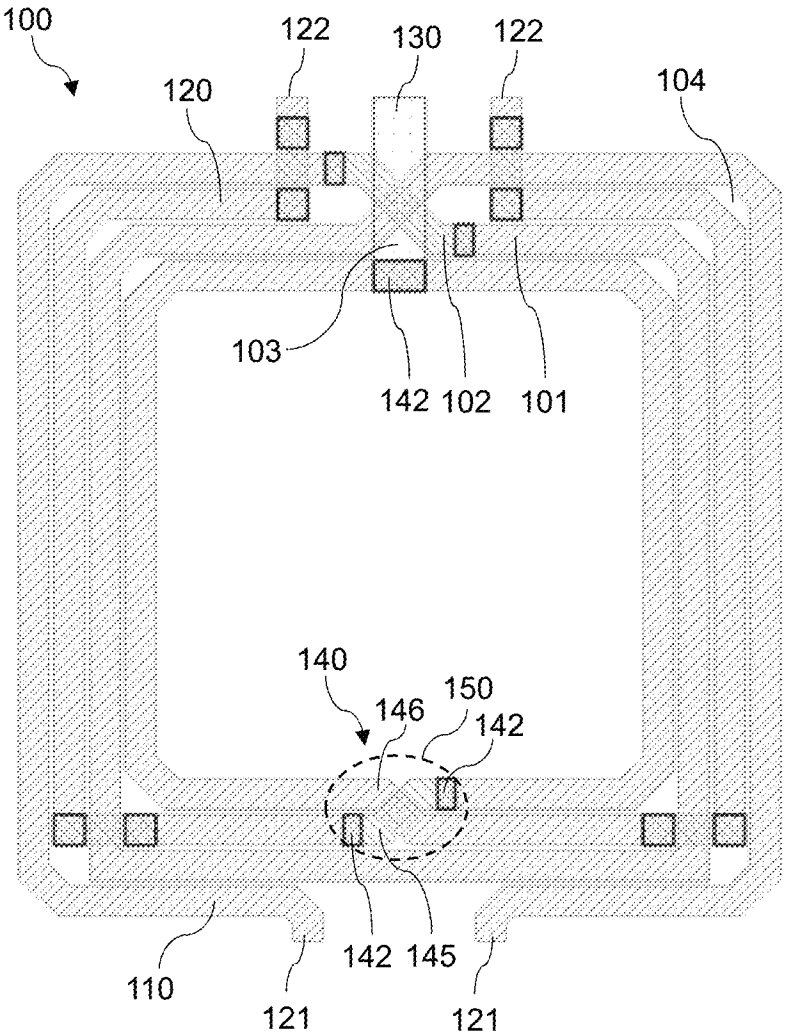

FIGS. 1-3 illustrate balun transformers, which are provided by way of example. Specifically, FIG. 1 illustrates a first balun transformer 100 having a substantially symmetrical configuration, a 1:1 turns ratio of the secondary winding 120 to the primary winding 110, and a center tap 130. The first balun transformer 100 may include three distinct metal layers formed substantially coplanar to one another within a substrate 104—a first metal layer 101 (i.e., where the bulk of the windings are disposed), a second metal layer 102 (i.e., where the windings utilize the second metal layer 102 such that they remain separate in crossovers 140), and a third metal layer 103 (i.e., for the center tap 130 to cross the windings while remaining separate therefrom). The primary winding 110 and the secondary winding 120 may be substantially disposed in the first metal layer 101 (e.g., which may be a top metal layer on the substrate 104). Where the primary winding 110 and the secondary winding 120 form crossovers 140 (either with themselves, or with one another) when traversing between winding segments, vias 142 may be used to bridge the first metal layer 101 and the second metal layer 102 such that connectors between winding segments remain separate from one another within a crossover 140. For example, in location 150, the secondary winding 120 forms a crossover 140 with itself, where a first connector 145 traverses, using vias 142, from the first metal layer 101 to the second metal layer 102 (e.g., which may be a middle metal layer on the substrate 104) such that the first connector 145 is disposed below a second connector 146, thereby maintaining the secondary winding 120 as a continuous electrically conductive path between its ends (i.e., the secondary ends 122; the primary ends 121 are also shown as having a continuous electrically conductive path formed therebetween). Stated otherwise, connectors are used to bridge winding segments while vias 142 are used to bridge metal layers, but both are used in conjunction with one another in a crossover 140 to maintain separation between windings that intersect.

As shown in the figure, the center tap 130 is disposed in the third metal layer 103 (which may be a bottom metal layer on the substrate 104) such that it is isolated from the primary winding 110 and the secondary winding 120 until it connects to the secondary winding 120 using a via 142. While the first balun transformer 100 may have a substantially symmetrical configuration, the geometry shown calls for an additional metal layer to be present for the center tap 130, which may not be advantageous for manufacturing.

FIG. 2 illustrates a second transformer 200 having a generally asymmetric shape with the input/output ports 202 disposed near one another, and where the windings are formed in what is known as the "bifilar" layout style. FIG.

3 illustrates a third transformer 300 having a generally symmetric shape with the input/output ports 302 isolated from one another, and where the windings are also formed in a bifilar layout style. The second transformer 200 and the third transformer 300 each include a 1:1 turns ratio, where, if the secondary winding was removed, the primary winding would be a simple spiral inductor. Thus, the secondary winding is merely interwoven alongside the primary winding to maximize the coupling. However, in both of the transformers shown in FIGS. 2 and 3, determination of a precise center-tap point may be difficult, and without an accurate center-tap point, the isolation and common mode rejection ratio performance of the transformer may be compromised. Further, it will be understood that neither of the transformers shown in FIGS. 2 and 3 are implementing a balun as they stand, only a transformer, where both structures could be made into a balun transformer through the introduction of a center-tap point. However, if that were done, the second transformer 200 of FIG. 2 would still be fundamentally asymmetrical and thus relatively lower-performing (because it would have worse isolation than embodiments described herein). The third transformer 300 of FIG. 3 would similarly have a center tap disposed in an inconvenient location, thus making the structure asymmetrical and having a lower performance due to worse isolation than embodiments described herein.

It will be understood that other types of balun transformers are present in the art, and that the representations in FIGS. 1-3 are provided by way of example only, and not of limitation. Regardless, various balun transformers in the art generally lack certain advantages that can be provided by the balun transformers described herein.

Figure 4:
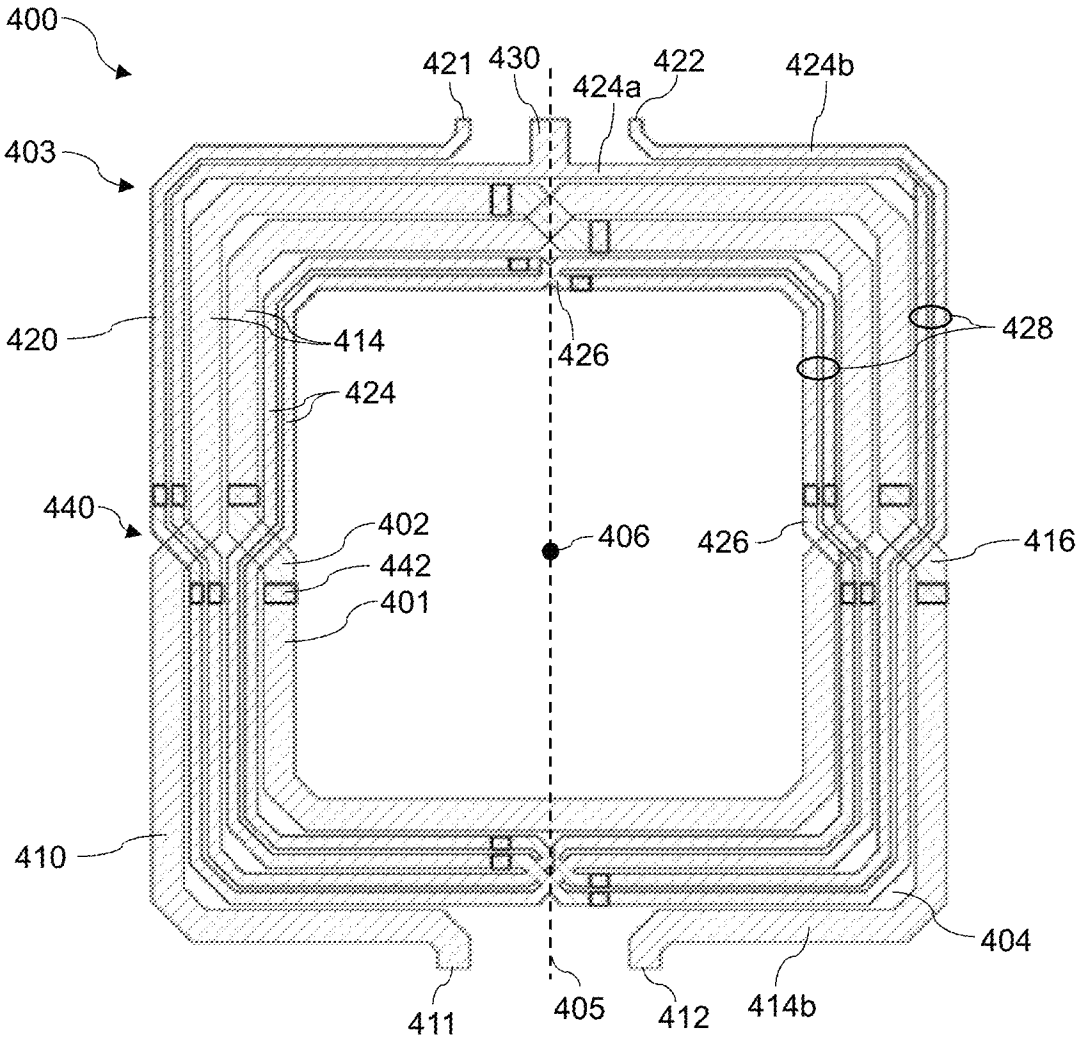
FIG. 4 illustrates a balun transformer, in accordance with a representative embodiment.

FIG. 4 illustrates a balun transformer 400, in accordance with a representative embodiment. The balun transformer 400 shown in FIG. 4 may include a first winding 410 (which may be the primary winding or primary conductor of a balun transformer 400) and a second winding 420 (which may be the secondary winding or secondary conductor of a balun transformer 400) that form a resultant pattern 403 that is substantially symmetrical relative to an axis 405 intersecting a central axis 406 about which the windings circumnavigate. In certain implementations, the balun transformer 400 includes only two metal layers—e.g., a first metal layer 401 and a second metal layer 402—formed in a substrate 404 (e.g., where the first metal layer 401 and the second metal layer are disposed co-planar to one another on the substrate 404). In general, the first winding 410 may follow a first winding path and the second winding 420 may follow a second winding path, where the second winding path is at least partly interwoven with, but independent from, the first winding path, and where the winding paths form the resultant pattern 403, which may be substantially symmetrical as explained above. It will be understood that "substantially symmetrical" shall include cases where the pattern is fully symmetrical, "close to" symmetrical, or semi-symmetrical—e.g., a pattern that does not include any imperfections or the like without which the pattern would be symmetrical, or where overall patterns formed by winding paths substantially resemble one another across one or more axes (such as the axis 405 shown in the figure).

The balun transformer 400 shown in the figure includes a 2:1 turns ratio, but other ratios are of course possible. The balun transformer 400 may maintain the resultant pattern 403 regardless of the turns ratio, because, as explained herein, the second winding 420 may include a number of sub-windings 428 that follow the second winding path, such that the second winding 420 includes more winding segments than the first winding 410.

The first winding 410 may be formed in one or more of the first metal layer 401 and the second metal layer 402 along the first winding path, and the second winding 420 may be formed in one or more of the first metal layer 401 and the second metal layer 402 along the second winding path. Thus, the first winding 410 generally follows the first winding path and the second winding 420 generally follows the second winding path. Stated otherwise, the winding paths are the paths/patterns that the windings follow to form the resultant pattern 403 of the balun transformer 400. And, in other words, the first winding 410 and the second winding 420 are formed according to their respective winding paths within the metal layers of the balun transformer 400. It will thus be understood that reference to the first winding path and the second winding path herein may generally also include the first winding 410 and the second winding 420, respectively, i.e., because the windings are disposed along these paths. Each of the first winding path and the second winding path may be wound to an interior and then wound to an exterior of the resultant pattern 403.

The first winding path may be formed between a first end 411 and a second end 412. The first end 411 and the second end 412 may form the ends of the first winding 410, where the first winding 410 is continuous therebetween. The first winding path may include a plurality of first winding segments 414 each disposed around the central axis 406 of the balun transformer 400. The first winding path may also include a plurality of first connectors 416, where each of the plurality of first connectors 416 joins adjacent first winding segments 414 such that the first winding path is continuous between the first end 411 and the second end 412 while being wound from the exterior to the interior (and back).

The second winding path may be formed between a third end 421 and a fourth end 422. The third end 421 and the fourth end 422 may form the ends of the second winding 420, where the second winding is continuous therebetween. As stated above, the second winding path may be at least partly interwoven with, but independent from, the first winding path. The first winding path and the second winding path may form the resultant pattern 403 that is substantially symmetrical relative to the axis 405 intersecting the central axis 406. The second winding path may include a plurality of second winding segments 424 each disposed around the central axis 406 of the balun transformer 400. The second winding path may also include a plurality of second connectors 426, where each of the plurality of second connectors 426 joins adjacent second winding segments 424 such that the second winding path is continuous between the third end 421 and the fourth end 422 while being wound from the exterior to the interior (and back).

As discussed above, the first winding 410 may be formed in one or more of the first metal layer 401 and the second metal layer 402 along the first winding path, and the second winding 420 may be formed in one or more of the first metal layer 401 and the second metal layer 402 along the second winding path. In addition, the second winding 420 may include a number, n, of sub-windings 428, where n>1 such that a resultant number of second winding segments 424 of the second winding 420 is greater than a resultant number of first winding segments 414 of the first winding 410 by a factor of n. For example, as shown in the figure, n may be equal to 2, such that the balun transformer 400 has a 2:1 turns ratio. In certain implementations, n is an even number. In other implementations, n may be an odd number. In certain implementations, n is a multiple of the resultant number of first winding segments 414. For example, there may be two sub-windings 428 for every first winding segment 414 (as shown in the figure). There may instead be four sub-windings 428 for every first winding segment 414. There may instead be eight or sixteen sub-windings 428 for every first winding segment 414. Other multiples are also or instead possible, as will be understood by a person having skill in the art.

The balun transformer 400 may further include a center tap 430 formed in one of the first metal layer 401 or the second metal layer 402. In this manner, the balun transformer 400 may include only two metal layers, which may be advantageous to simplify manufacturing and reduce cost of the balun transformer 400. As shown in the figure, the center tap 430 may be connected to a second winding segment 424*a* that is adjacent to the outermost second winding segment 424*b*. Using this design, the center tap 430 can travel from outside of the resultant pattern 403 to connect to the second winding 420 without having to cross the first winding 410. Thus, in certain implementations, one or more second winding segments 424*a* that are adjacent to the outermost second winding segment 424*b* lack a second connector 426 along at least one side of the balun transformer 400 such that the second winding 420 forms an electrically conductive path continuous between the third end 421 and the fourth end 422.

The first winding 410 and the second winding 420 may include crossovers 440, e.g., where the first winding 410 and the second winding 420 interweave with one another, where the first winding 410 interweaves with itself, or where the second winding 420 interweaves with itself. However, as discussed above, the balun transformer 400 may include only two metal layers in an implementation. To this end, each of the plurality of first connectors 416 and second connectors 426 may cross another one of either a first connector 416 or a second connector 426 in different metal layers such that the connectors remain separate in such crossovers 440. A via 442 may be used to provide for such a crossover 440. Thus, the balun transformer 400 may further include one or more vias 442 connected to one or more of the first winding 410 and the second winding 420, where the via 442 forms a bridge between metal layers such that one or more of the first connectors 416 and the second connectors 426 is disposed in a different metal layer when forming a crossover 440. In this manner, and because of the resultant pattern 403, the balun transformer 400 may include only two metal layers.

In certain implementations, a majority of each of the first winding 410 and the second winding 420 is formed in the first metal layer 401. Thus, at least fifty percent of the connectors (the first connectors 416 and the second connectors 426) may be formed in the second metal layer 402. Stated otherwise, one or more of the first winding 410 and the second winding 420 may only leave the first metal layer 401 (using a via 442) to traverse to the second metal layer 402 when forming a crossover 440.

As shown in the figure, the first end 411 and the second end 412 may be connected to an outermost first winding segment 414*b*, and the third end 421 and the fourth end 422 may be connected to an outermost second winding segment 424*b*. The first end 411 and the second end 412 may be disposed opposite the third end 421 and the fourth end 422.

The overall shape of the resultant pattern may be substantially polygonal as shown in the figure. Thus, one or more of the first winding segments 414 and the second winding segments 424 may have a generally polygonal shape. For example, one or more of the first winding segments 414 and the second winding segments 424 may be substantially rectangular, or substantially square as shown in the figure. Instead, one or more of the first winding segments 414 and the second winding segments 424 may be substantially triangular, quadrilateral, pentagonal, hexagonal, heptagonal, octagonal, and so on. Further, one or more of the first winding segments 414 and the second winding segments 424 may have chamfered or beveled corners as shown in the figure, or one or more of the first winding segments 414 and the second winding segments 424 may have rounded corners. Also, or instead, one or more of the first winding segments 414 and the second winding segments 424 may be rounded. For example, one or more of the first winding segments 414 and the second winding segments 424 may be substantially circular, oval, oblong-shaped, and so on. Other geometries are also or instead possible.

In certain implementations, one or more of the first winding 410 and the second winding 420 may include a change in cross-sectional diameter along its length. For example, one or more of the first winding 410 and the second winding 420 may be tapered along its length.

It will be understood that the balun transformer 400 may be made from a variety of materials depending on the purpose of the device. By way of example, one or more of the first metal layer 401 and the second metal layer 402 may include at least one of copper and aluminum, and the substrate 404 may include at least one of silicon, gallium arsenide, gallium nitride, a ceramic material, and an organic material.

It will also be understood that, although the first winding 410 is described above as being the primary winding of an embodiment of the device, the first winding 410 may instead represent the secondary winding. Thus, in an implementation, the second winding 420 is the primary winding and the first winding 410 is the secondary winding in a transformer.

A transformer as described herein, e.g., the balun transformer 400 shown in FIG. 4, may include certain advantages over other transformers e.g., the balun transformers shown in FIGS. 1-3. For example, the balun transformer 400 may be constructed using only two metal layers, which provides for improved manufacturability, e.g., in terms of manufacturing cost and complexity. Also, the center tap 430 may be accessible on the same side as one of the windings (i.e., the second winding 420 shown in the figure), e.g., the secondary winding. This may provide for no crossing over or crossing under of the center tap 430 with the windings, thus allowing for the use of only two metal layers. Also, this may provide advantages for certain DC feeds, particularly in an embodiment including a transmitter or power amplifier. Also, a transformer as described herein may provide a desired turns ratio, e.g., 2:1 as shown in FIG. 4. A transformer as described herein may also provide for a relatively compact layout. Further, a transformer as described herein may provide for a balanced device, which can give rise to improved balun common mode rejection ratio (CMRR), which can be beneficial for both receiving and transmitting using a device. For example, in transmitting, the balancing may have a relatively large effect on even-order harmonics, e.g., the second harmonic.

FIGS. 5-12 illustrate stages of a method of making a balun transformer, in accordance with a representative embodiment. By way of example, the method set forth in FIGS. 5-12 may be used to make a balun transformer that is the same or similar to that described with reference to FIG. 4 above. Thus, the method set forth in FIGS. 5-12 may include the formation of winding paths that create a substantially symmetrical pattern and that can be provided in only two metal layers of a substrate, where one of the winding paths is divided into sub-paths to create a desired turns ratio for a balun transformer.

Figure 6:
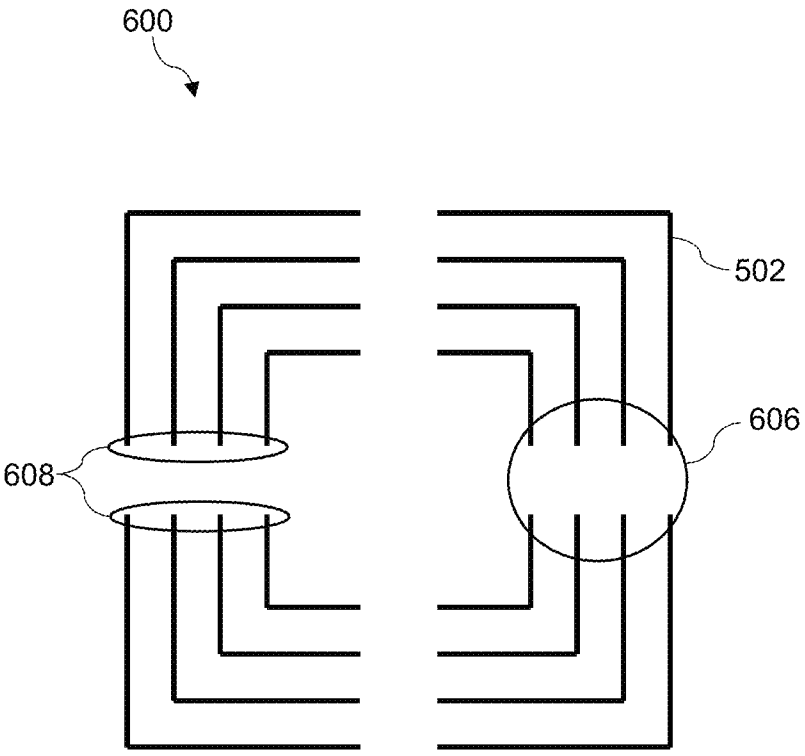
FIGS. 5-12 illustrate stages of a method of making a balun transformer, in accordance with a representative embodiment.
Figure 5:
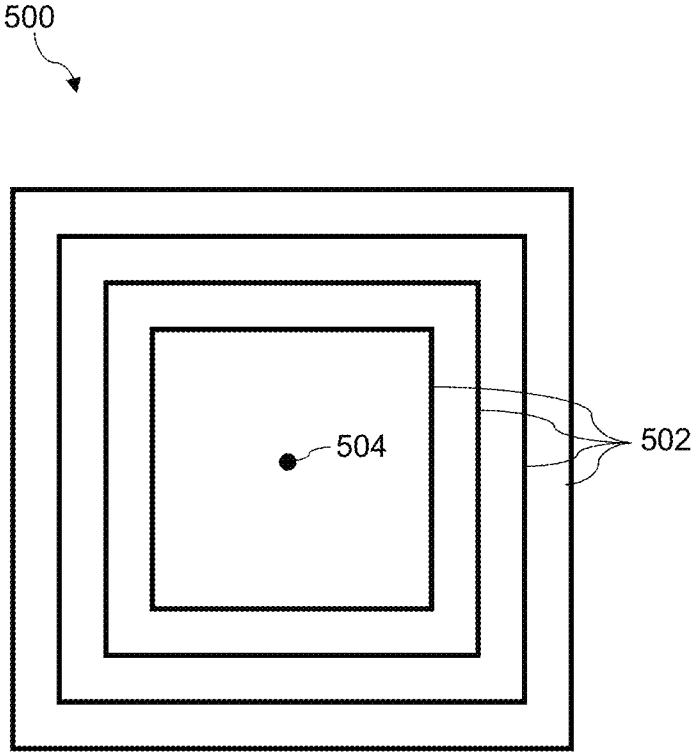
Figure 7:
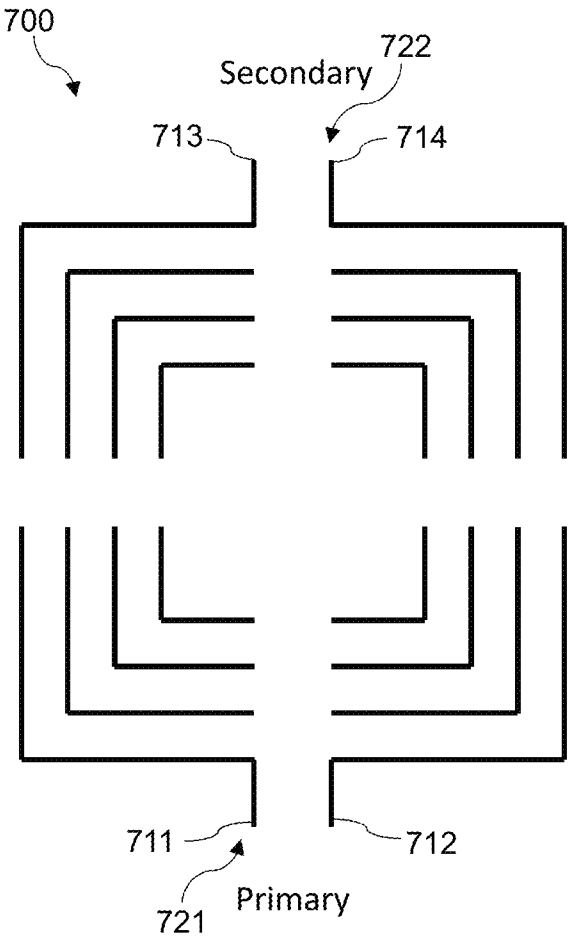

FIG. 5 illustrates a first stage 500 of a method of making a balun transformer, which may include arranging a plurality of shapes 502 substantially concentrically with one another around a center axis 504. Although the shapes 502 are shown as quadrilaterals, other shapes are also or instead possible, including other polygons and rounded shapes. FIG. 6 illustrates a second stage 600 of a method of making a balun transformer, which may include removing midsections 606 of each of the shapes 502 on a plurality of sides, e.g., on each side of the shapes 502 as shown in the figure. The removal of the midsections 606 may form a plurality of midsection ends 608 on the shapes 502. FIG. 7 illustrates a third stage 700 of a method of making a balun transformer, which may include forming ends (e.g., a first end 711, a second end 712, a third end 713, and a fourth end 714), and selecting a primary side (a first side 721) and a secondary side (a second side 722).

Figure 8:
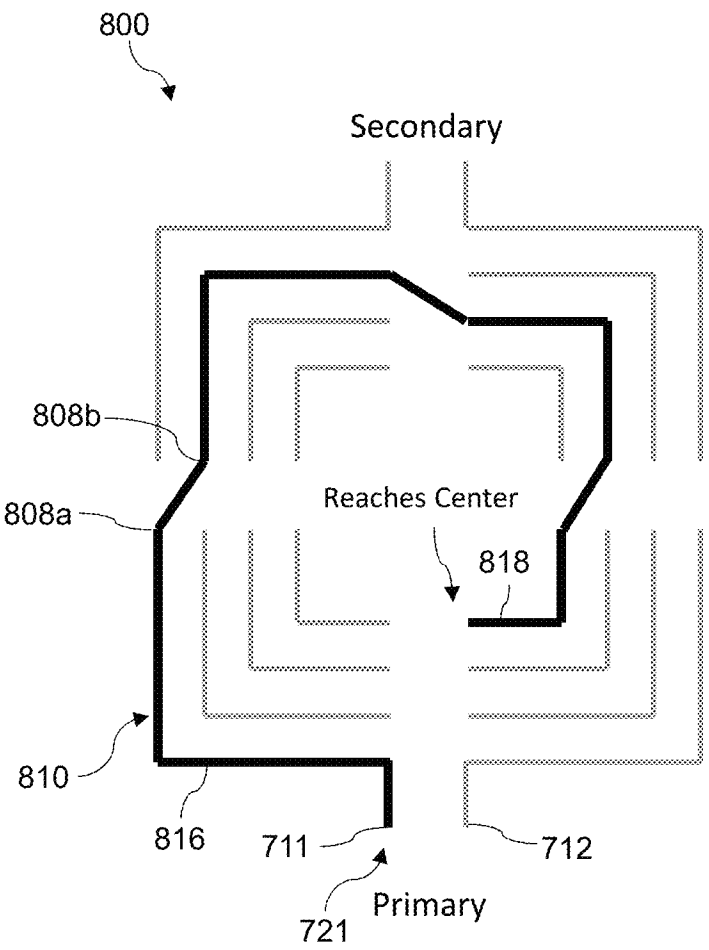

FIG. 8 illustrates a fourth stage 800 of a method of making a balun transformer, which may include connecting midsection ends (e.g., a first midsection end 808*a* with a second midsection end 808*b*) of adjacent shapes to form a first winding path 810 that is continuous between the first end 711 and the second end 712, where the first end 711 and the second end 712 are disposed on the first side 721 of an outermost shape 816. The first winding path 810 may traverse from the outermost shape 816 to an innermost shape 818 (and back from the innermost shape 818 to the outermost shape 816 as shown, e.g., in FIG. 9). Thus, FIG. 9 illustrates a fifth stage 900 of a method of making a balun transformer, which may include, once the innermost shape 818 is reached, staying in the same inner loop by forming a connection 924, and then winding to the exterior as shown by reference number 926 at each midsection end 608.

Figure 9:
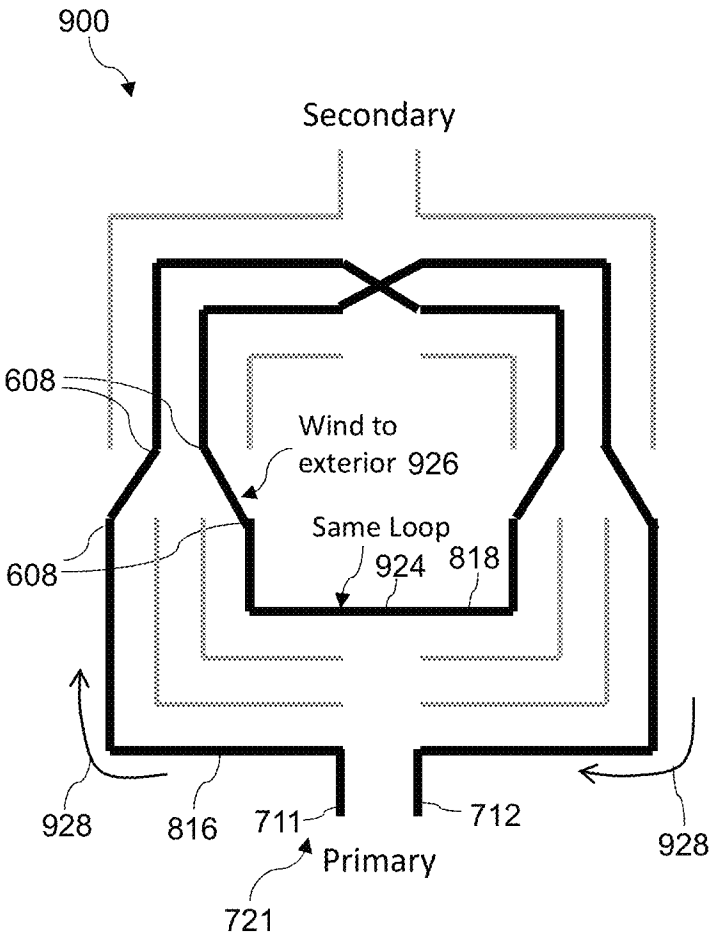

Thus, the fourth stage 800 shown in FIG. 8 and the fifth stage 900 shown in FIG. 9 may include traversing in a first direction as indicated by the arrow 928 in FIG. 9. As shown by the arrow 928, the first direction may be clockwise. Instead, the first direction may be counter-clockwise.

When traversing in the first direction from the first end 711, each of the following may be true: (i) each midsection end 608 reached along the first direction connects to an opposing midsection end 608 on an adjacent shape until the innermost shape 818 is reached; (ii) a connection 924 is formed across a midsection of the innermost shape 818; and, when continuing to traverse in the first direction after the connection 924 across the midsection of the innermost shape 818, each midsection end 608 reached along the first direction connects to an opposing midsection end 608 on an adjacent shape until the outermost shape 816 is reached, leading to the second end 712. In implementations, as explained herein, a plurality of connections of midsection ends 608 may cross another connection of midsection ends 608 but remain separate by being provided in a different conductive layer of a balun transformer.

Figure 10:
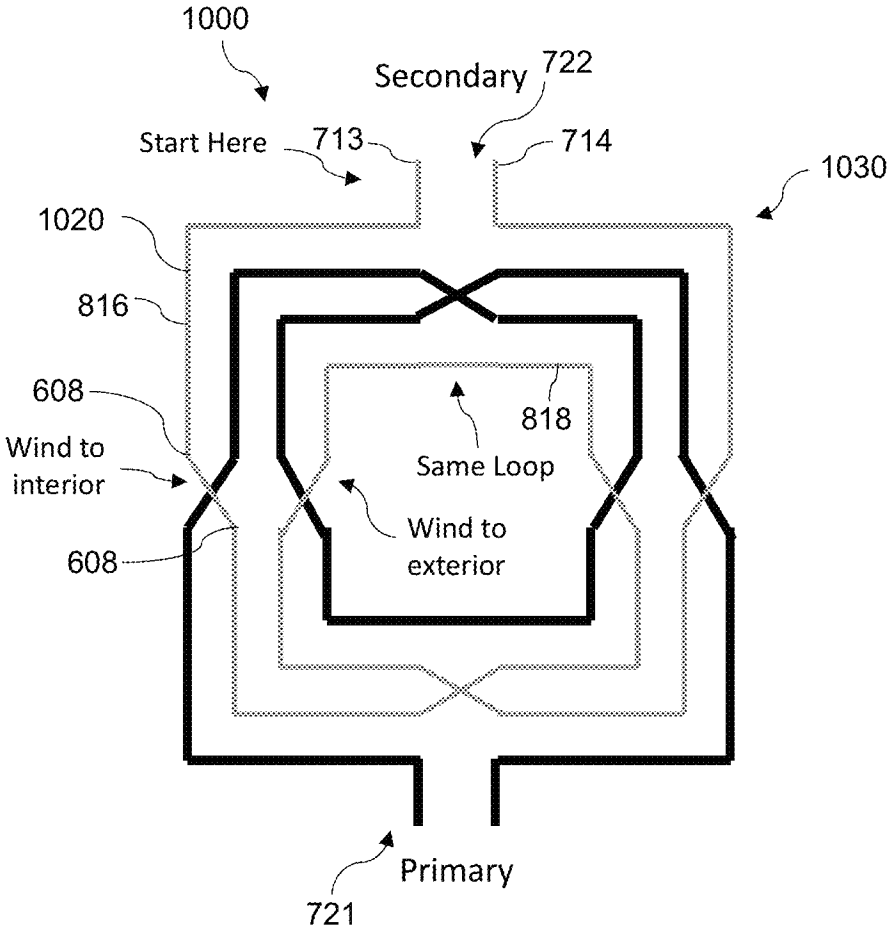

FIG. 10 illustrates a sixth stage 1000 of a method of making a balun transformer, which may include repeating stages described above for the second side 722 to form a continuous path between the third end 713 and the fourth end 714, i.e., a second winding path 1020. Thus, the sixth stage 1000 may include connecting midsection ends 608 of adjacent shapes to form the second winding path 1020 that is continuous between the third end 713 and the fourth end 714 on the second side 722 of the outermost shape 816 (where the second side 722 is opposite the first side 721). The second winding path 1020 may traverse from the outermost shape 816 to the innermost shape 818 and back. Using this method, the second winding path 1020 may be substantially symmetrical to the first winding path 810. As shown in FIG. 10, the pattern 1030 formed at this stage may be appropriate for a balun transformer with a 1:1 turns ratio.

Figure 11:
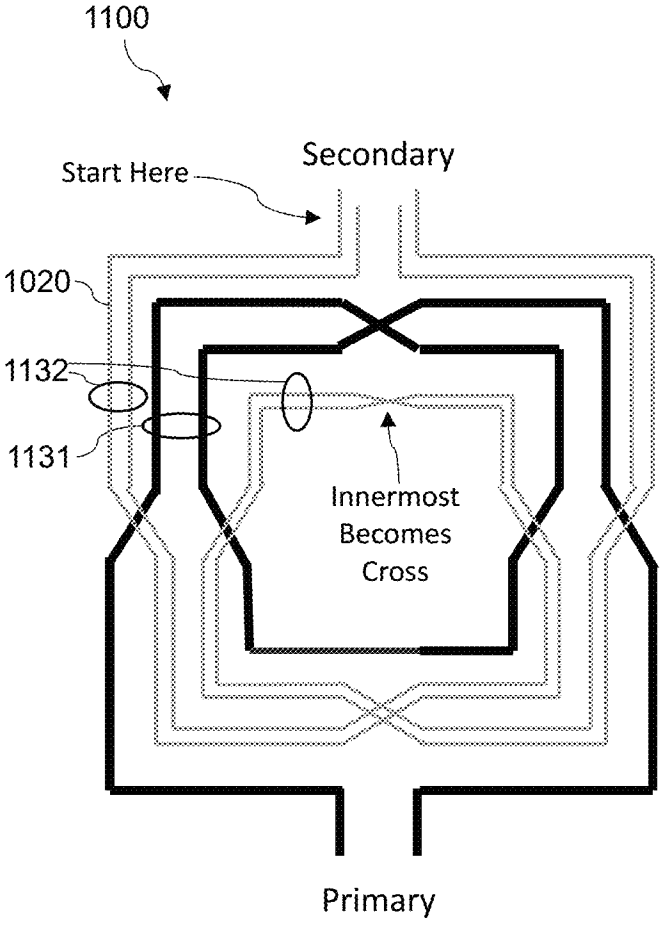

FIG. 11 illustrates a seventh stage 1100 of a method of making a balun transformer, which may include dividing the second winding path 1020 into a number, n, of sub-paths, where n>1 such that a resultant number of second winding segments 1132 of the second winding path 1020 is greater than a resultant number of first winding segments 1131 of the first winding path 810 by a factor of n. Thus, for a desired turns ratio, the second winding path 1020 may be parsed into a specific number of sub-windings. By way of example, FIG. 11 illustrates a balun transformer where n equals 2, i.e., a balun transformer having a turns ratio of 2:1, but other ratios are possible. In certain implementations, the width of one or more of the windings may be manipulated. For example, the primary turn width may be two times the secondary turn width, which can assist with minimizing spacing in the balun transformer.

Figure 12:
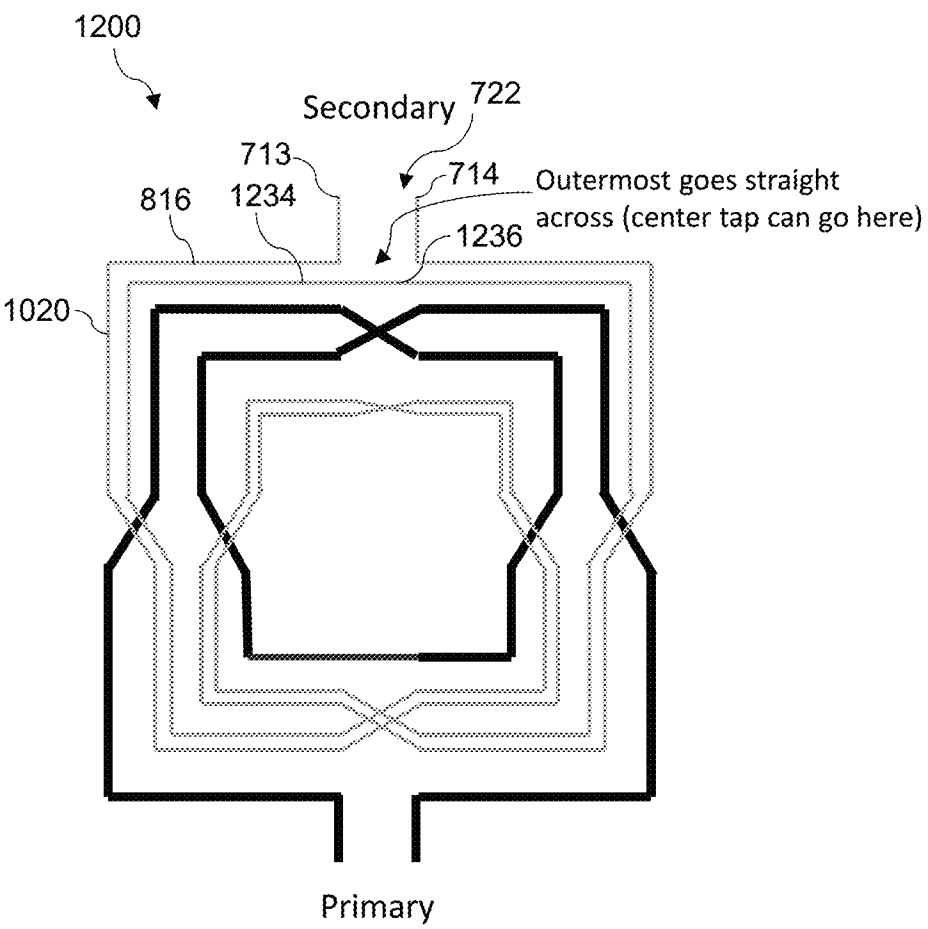

FIG. 12 illustrates an eighth stage 1200 of a method of making a balun transformer, which may include connecting ends of one or more sub-paths 1234 that are adjacent to the outermost shape 816 on the second side 722 such that the second winding path 1020 remains continuous between the third end 713 and the fourth end 714. The connection 1236 formed on such a sub-path 1234 adjacent to the outermost shape 816 may be used for a connection to a center tap.

The method set forth in FIGS. 5-12 may also include forming the winding paths in two metal layers on a substrate, and addressing the metals so that no shorts occur.

Figure 13:
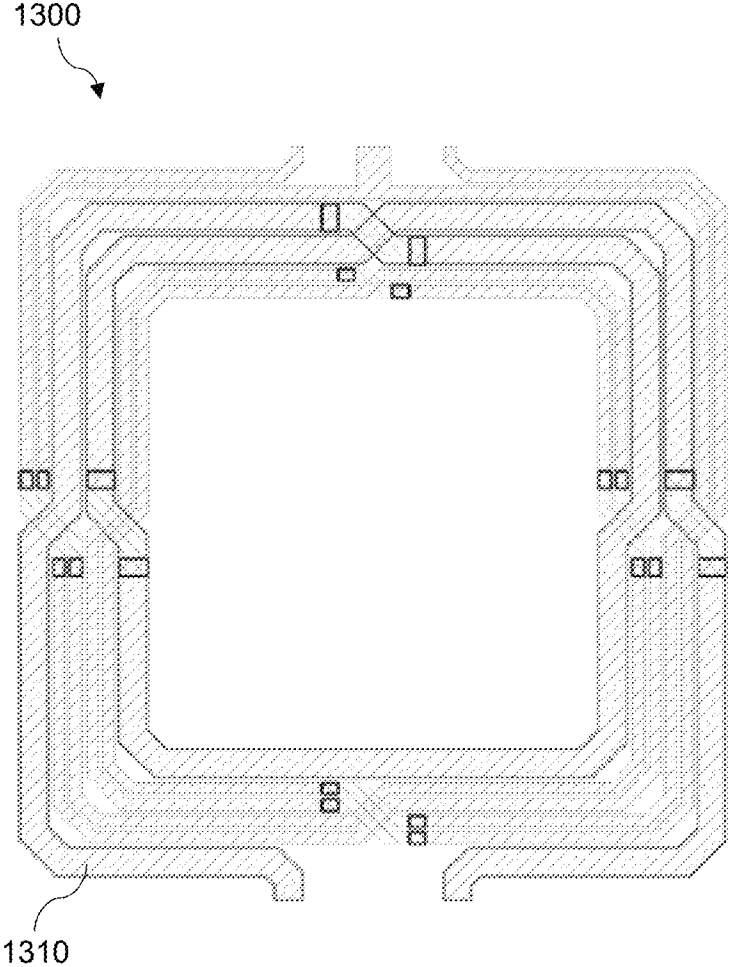
FIG. 13 illustrates a balun transformer with a primary winding shown in a bold outline, in accordance with a representative embodiment.

FIG. 13 illustrates a balun transformer 1300 with a primary winding shown in a bold outline, in accordance with a representative embodiment. The balun transformer 1300 shown in this figure may be the same or similar to the transformer shown in FIG. 4, but with the primary winding (i.e., the first winding 1310 shown in the figure) shown in a bold outline for ease of reference. Thus, the balun transformer 1300 shown in this figure includes a 2:1 turns ratio.

Figure 14:
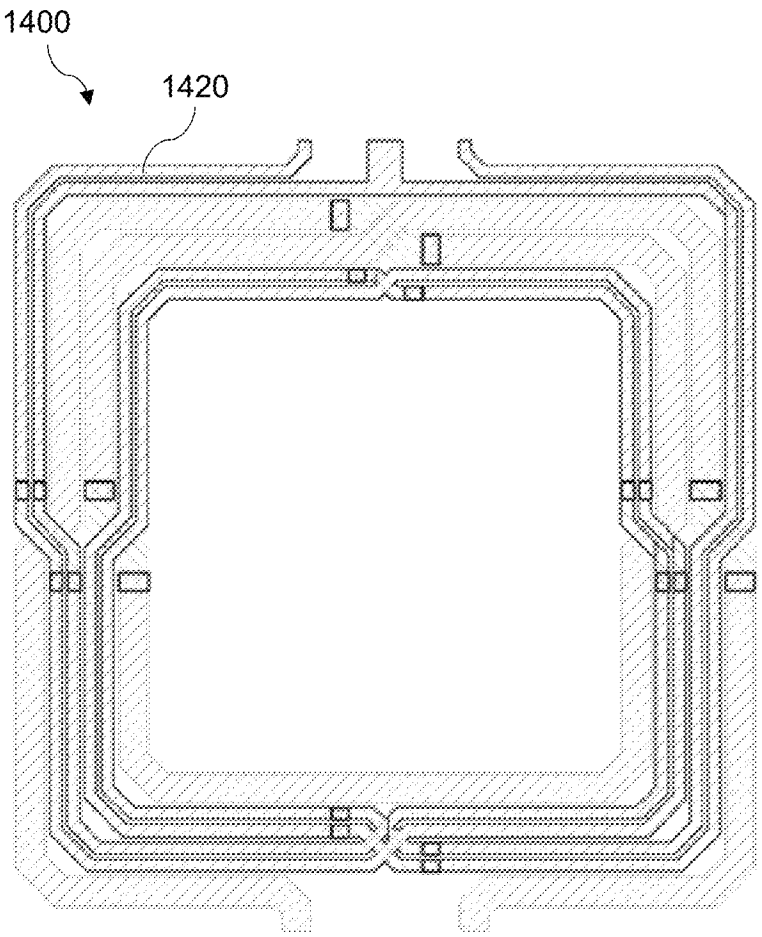
FIG. 14 illustrates a balun transformer with a secondary winding shown in a bold outline, in accordance with a representative embodiment.
Figure 18:
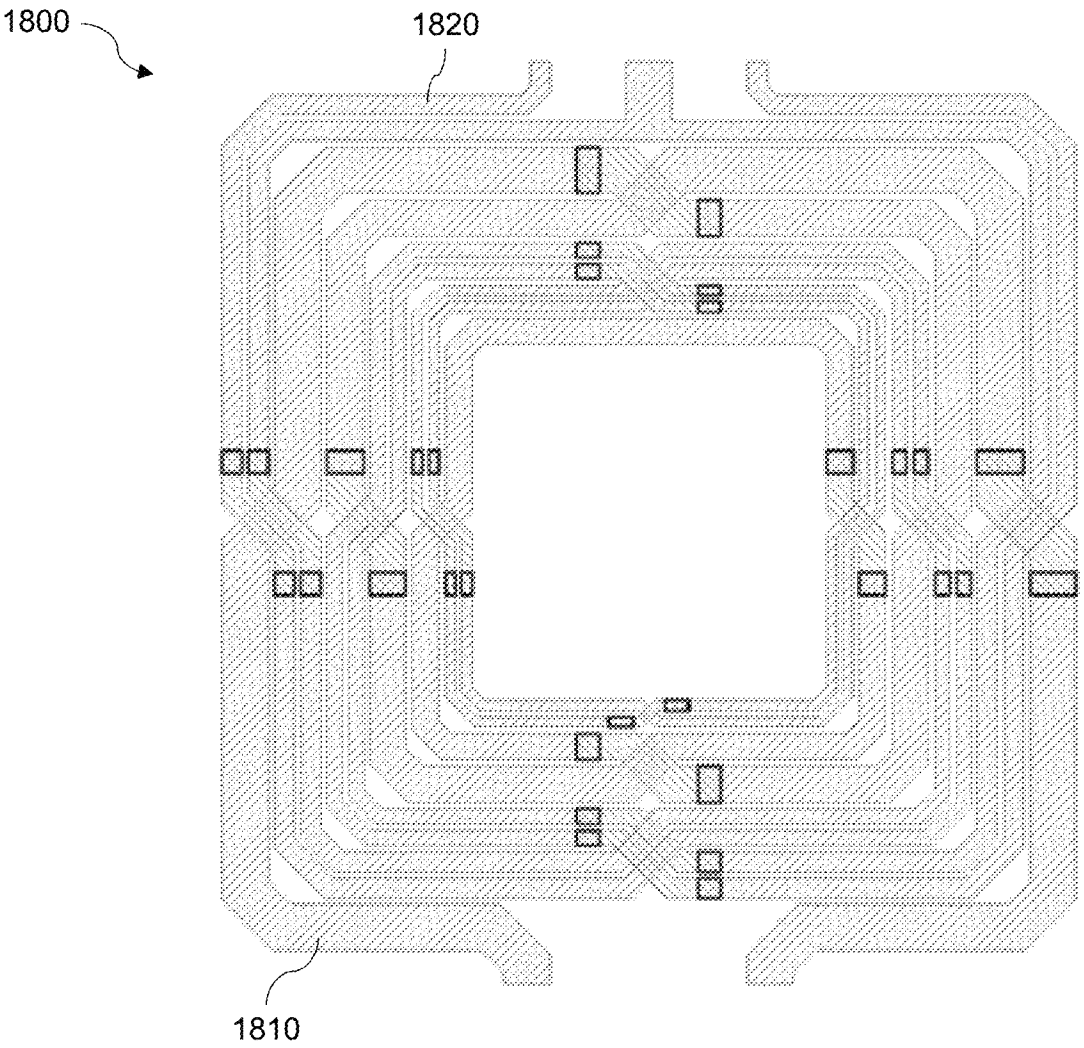
FIG. 18 illustrates a balun transformer having tapered windings, in accordance with a representative embodiment.

FIG. 14 illustrates a balun transformer 1400 with a secondary winding shown in a bold outline, in accordance with a representative embodiment. The balun transformer 1400 shown in this figure may be the same or similar to the transformer shown in FIGS. 4 and 13, but with the secondary winding (i.e., the second winding 1420 shown in the figure) shown in a bold outline for ease of reference. It will be understood that the primary winding being shown as thicker than the secondary winding may be for the sake of representation—i.e., the primary winding and the secondary winding may be the same thickness, or the secondary winding may be thicker than the primary winding. However, it will also be understood that a device may include a primary winding that is thicker than the secondary winding as shown in the figure. Additionally, the thickness of the windings may vary, e.g., such as in a transformer with one or more tapered windings as shown in FIG. 18, described below.

Figure 15:
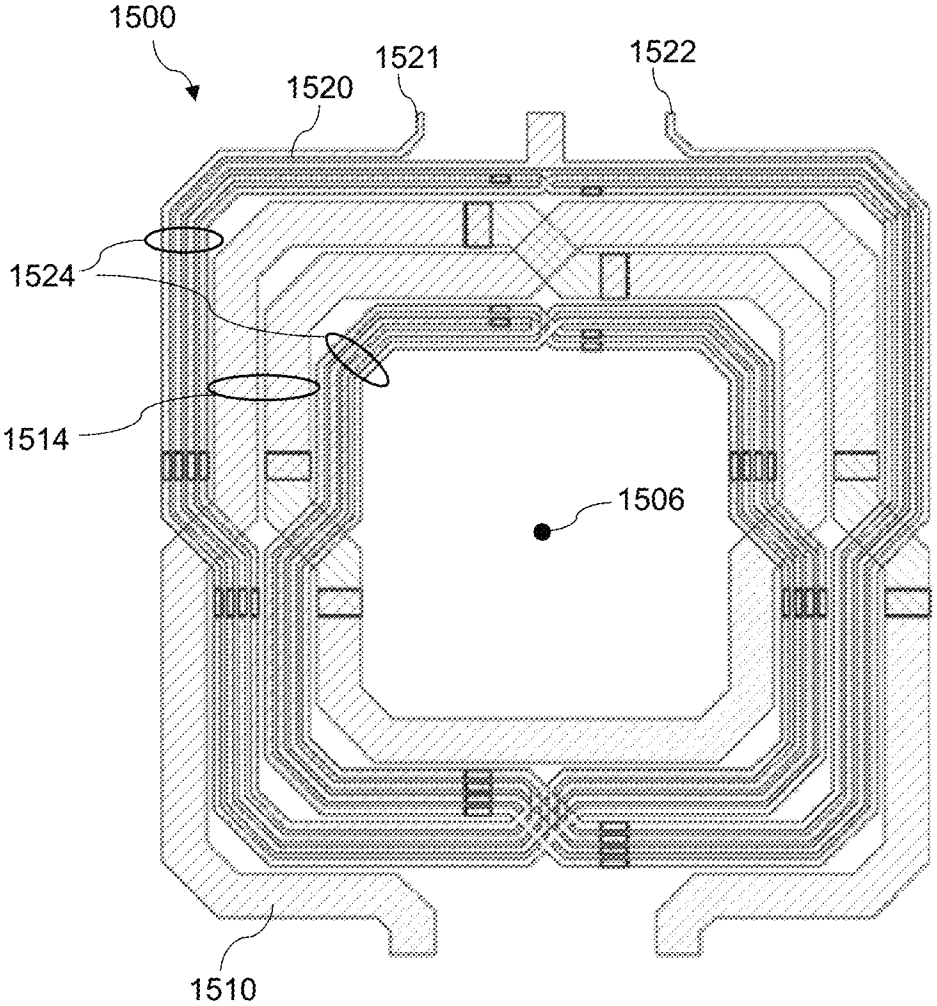
FIG. 15 illustrates a balun transformer, in accordance with a representative embodiment.

FIG. 15 illustrates a balun transformer 1500, in accordance with a representative embodiment. The balun transformer 1500 shown in this figure includes a 4:1 turns ratio. In other words, the balun transformer 1500 includes a first winding 1510 having a plurality of first winding segments 1514 that traverse around a central axis 1506, and a second winding 1520 having a plurality of second winding segments 1524 that traverse around the central axis 1506, where there are four times the number of second winding segments 1524 than first winding segments 1514. Although there is a plurality of second winding segments 1524, using the design of the balun transformer 1500 as described herein, the second winding 1520 can be traced from the third end 1521 to the fourth end 1522 in one continuous, conductive path. Also, using the techniques described herein, the balun transformer 1500 maintains a symmetrical design, even with the increased turns ratio. It will be understood that the balun transformer 1500 is shown by way of example only, and that other turns ratios are also or instead possible.

Figure 16:
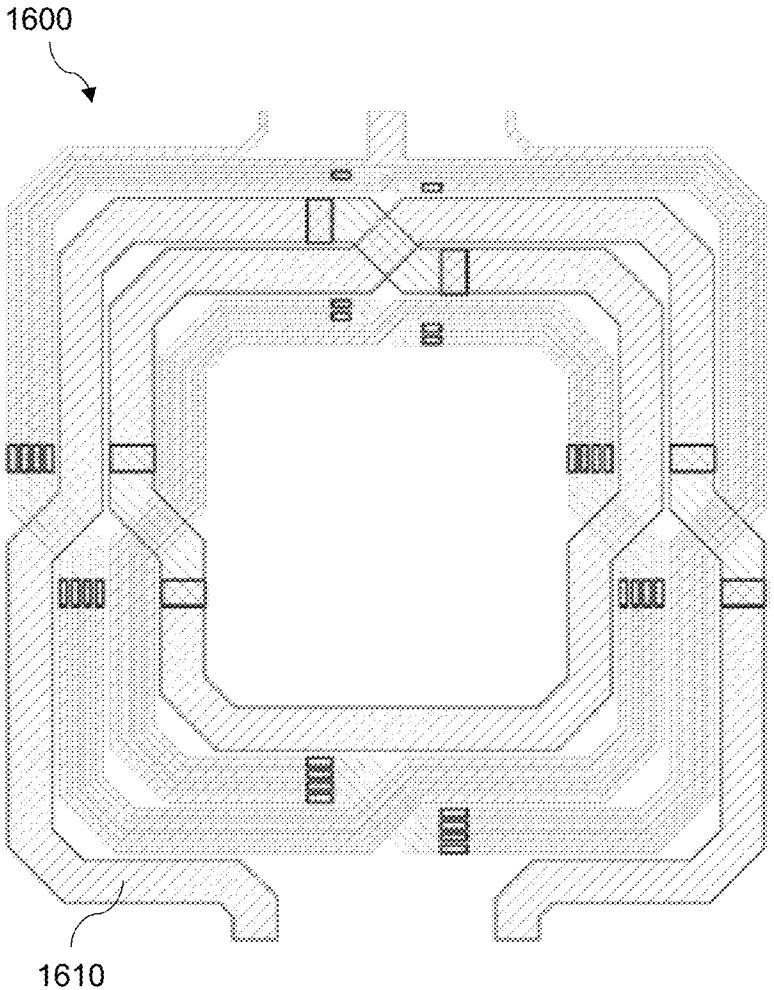
FIG. 16 illustrates a balun transformer with a primary winding shown in a bold outline, in accordance with a representative embodiment.

FIG. 16 illustrates a balun transformer 1600 with a primary winding shown in a bold outline, in accordance with a representative embodiment. The balun transformer 1600 shown in this figure may be the same or similar to the transformer shown in FIG. 15, but with the primary winding (i.e., the first winding 1610 shown in the figure) shown in a bold outline for ease of reference. Thus, the balun transformer 1600 shown in this figure may include a 4:1 turns ratio.

Figure 17:
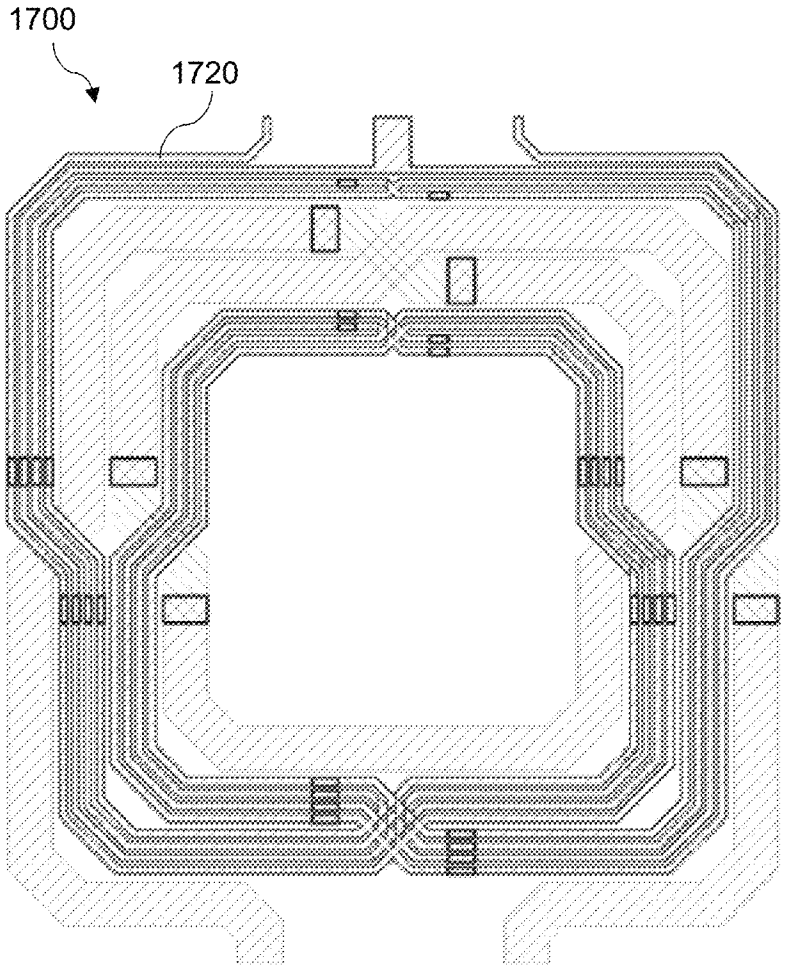
FIG. 17 illustrates a balun transformer with a secondary winding shown in a bold outline, in accordance with a representative embodiment.

FIG. 17 illustrates a balun transformer 1700 with a primary winding shown in a bold outline, in accordance with a representative embodiment. The balun transformer 1700 shown in this figure may be the same or similar to the transformer shown in FIGS. 15 and 16, but with the secondary winding (i.e., the second winding 1720 shown in the figure) shown in a bold outline for ease of reference.

FIG. 18 illustrates a balun transformer 1800 having tapered windings, in accordance with a representative embodiment. In general, a tapered winding may include a winding where its width is gradually decreased (or increased) as the winding goes inwards towards the center of the transformer. In the figure, the balun transformer 1800 includes a first winding 1810 that is tapered as well as a second winding 1820 that is also tapered. However, it will be understood that only one of the windings may be tapered in a device. Also, the balun transformer 1800 shows each winding as tapered in a manner such that the winding is thicker along the exterior of the balun transformer 1800, and thinner along the interior of the balun transformer 1800. However, it will be understood that the winding may be thicker along the interior of the balun transformer 1800, and thinner along the exterior of the balun transformer 1800. Other configurations are also or instead possible.

Figure 19:
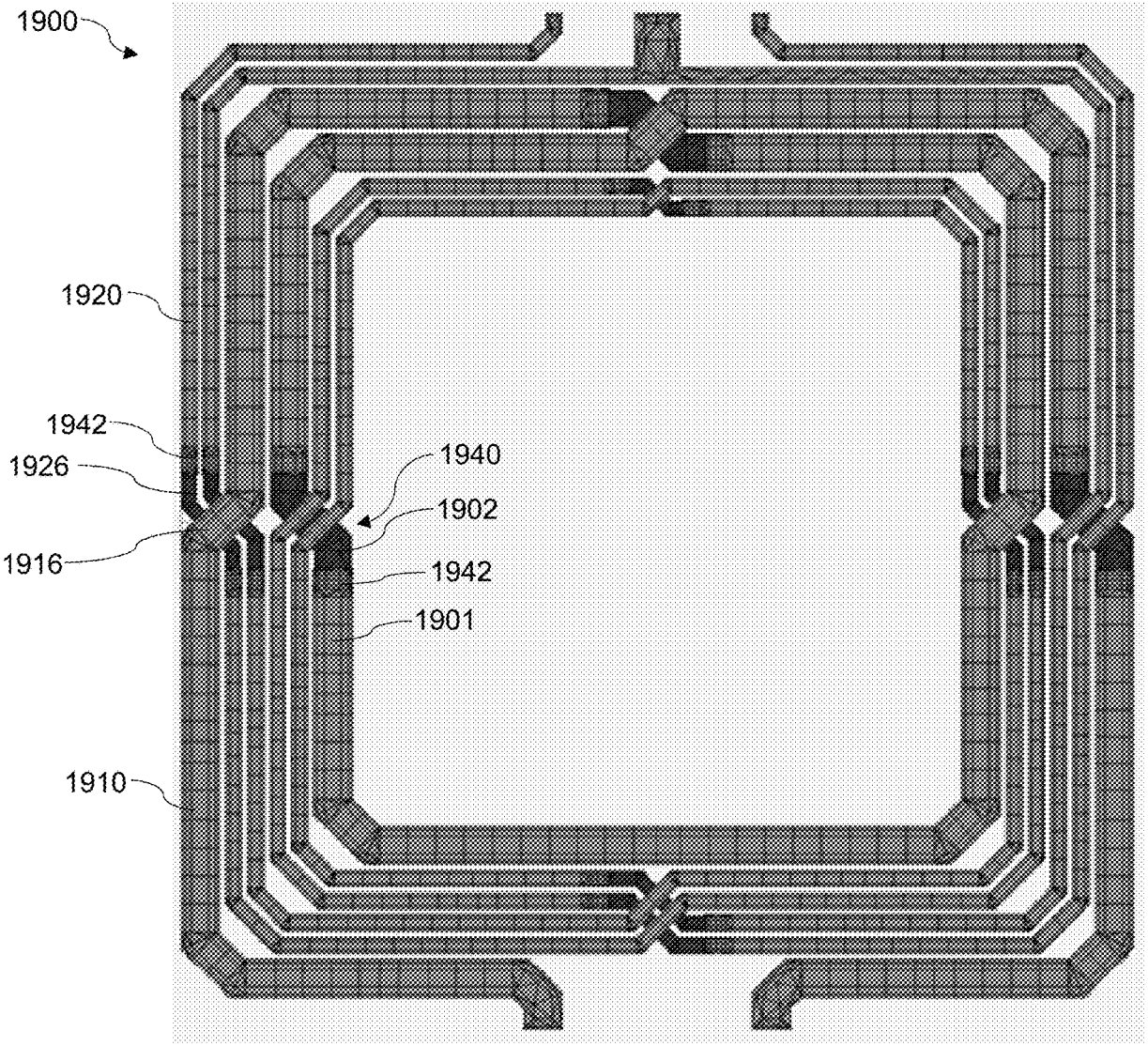
FIG. 19 illustrates a top view of a balun transformer, in accordance with a representative embodiment.

FIG. 19 illustrates a top view of a balun transformer 1900, in accordance with a representative embodiment. The balun transformer 1900 shown in this figure may include a 2:1 turns ratio, where a substantial portion of each of the windings is disposed in a first metal layer 1901. In the figure, first connectors 1916 (i.e., connectors along the first winding 1910) and second connectors 1926 (i.e., connectors along the second winding 1920) that are disposed in a second metal layer 1902 are shown darker than their counterpart connectors in the same crossover 1940. As described herein, the windings may traverse between metal layers using vias 1942.

Figure 20:
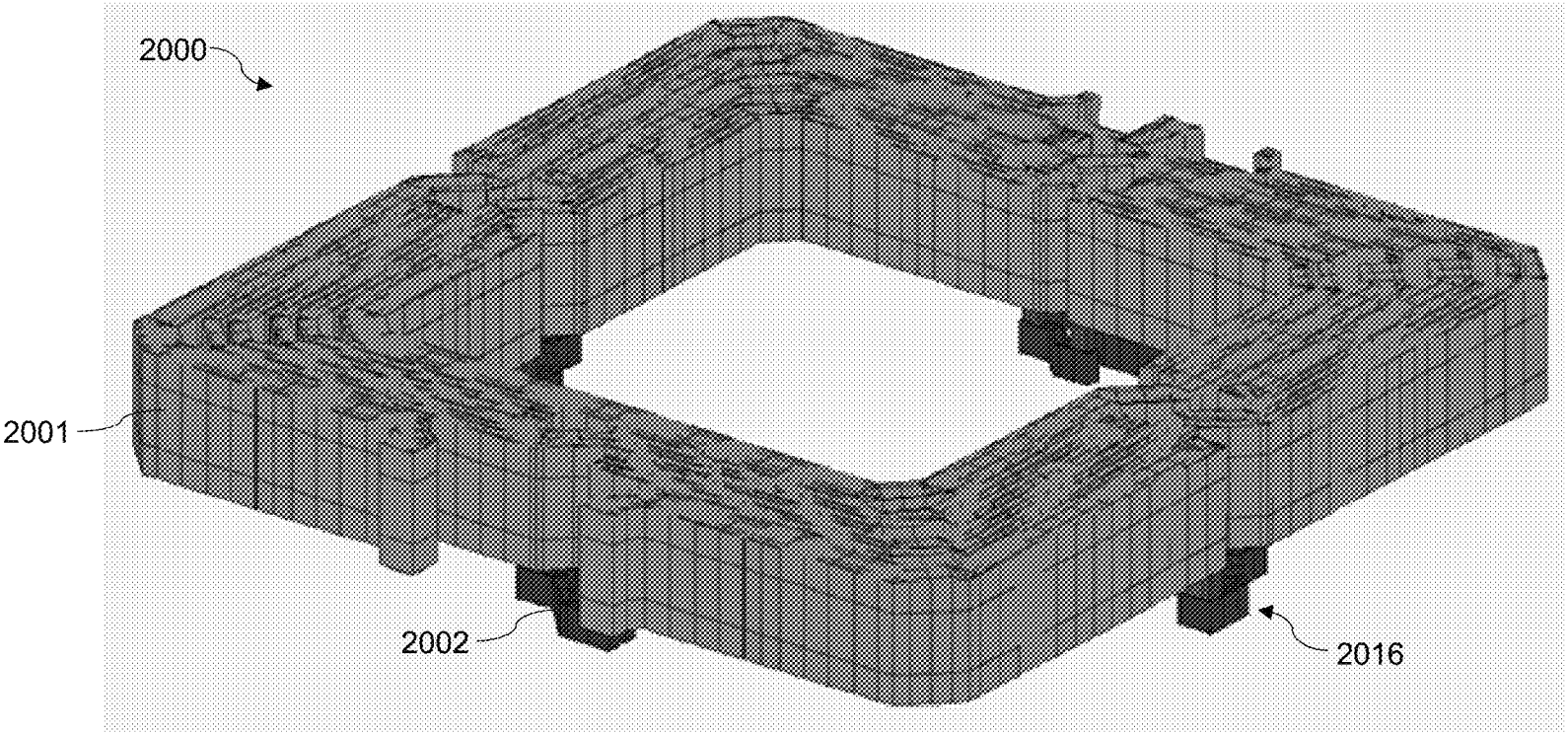
FIG. 20 illustrates a perspective view of a balun transformer, in accordance with a representative embodiment.

FIG. 20 illustrates a perspective view of a balun transformer 2000, in accordance with a representative embodiment. The balun transformer 2000 shown in this figure may be the same or similar to the transformer shown in FIG. 19, but it is shown here in a three-dimensional perspective view so that the connectors 2016 disposed in the second metal layer 2002 can be seen clearly. This figure also clearly shows the majority of each of the windings being disposed in a first metal layer 2001.

Figure 21:
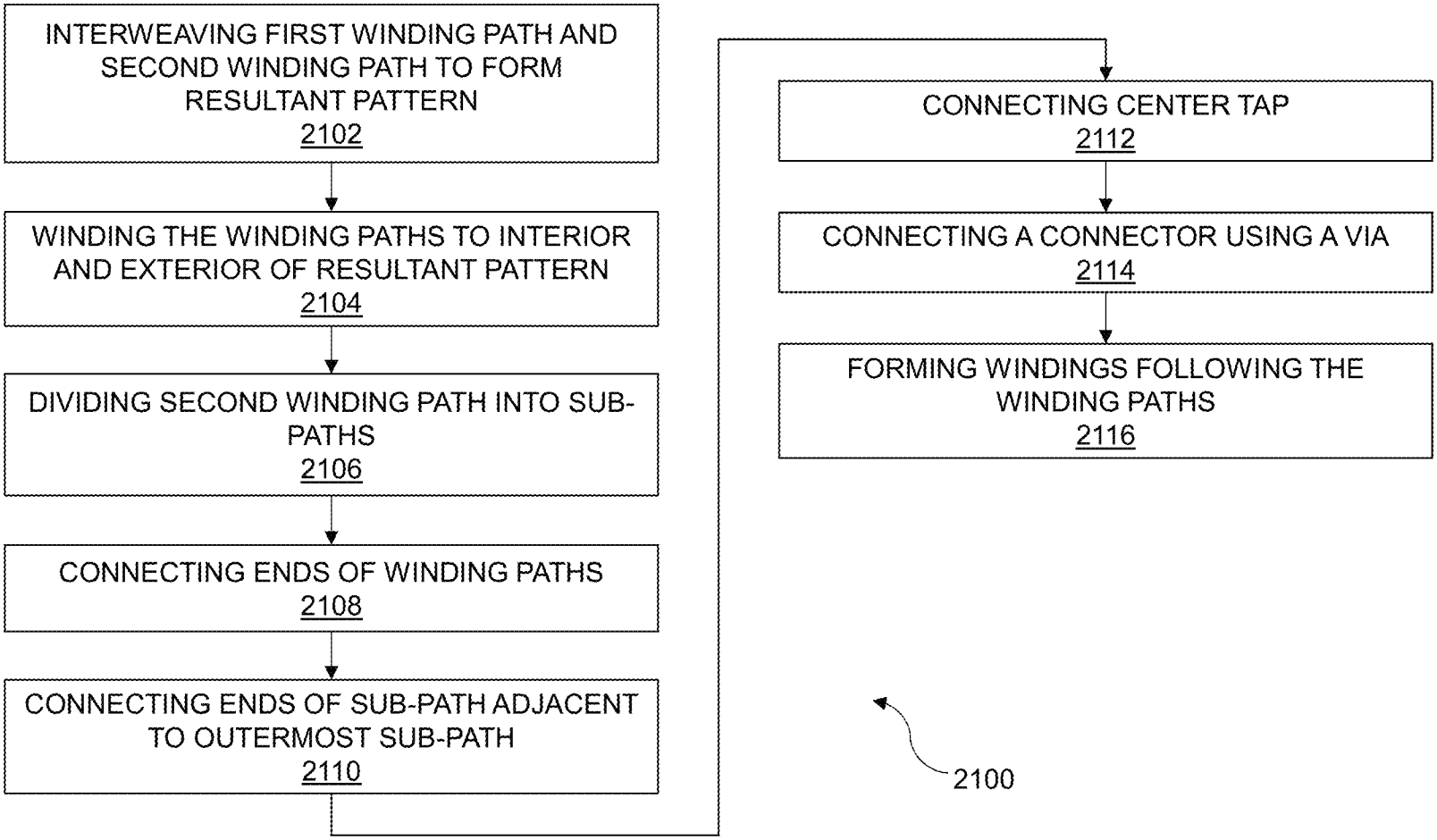
FIG. 21 is a flow chart of a method of making a balun transformer, in accordance with a representative embodiment.

FIG. 21 is a flow chart of a method of making a balun transformer, in accordance with a representative embodiment. In general, the method 2100 may include forming winding paths that create a symmetrical pattern, and then dividing a second winding path into sub-paths, as explained in further detail below.

As shown in block 2102, the method 2100 may include interweaving a first winding path and a second winding path to form a resultant pattern that is substantially symmetrical relative to an axis intersecting a central axis of the balun transformer, where the first winding path and the second winding path are each continuous between ends thereof. Each of the first winding path and the second winding path may include a plurality of winding segments disposed around the central axis and crossovers between the winding segments. The crossovers may be formed using a connector bridging the winding segments and a via bridging two conductive layers of the balun transformer to maintain separation of the first winding path and the second winding path between the two conductive layers.

As shown in block 2104, the method 2100 may include winding each of the first winding path and the second winding path to an interior of the resultant pattern, and then winding each of the first winding path and the second winding path to an exterior of the resultant pattern.

As shown in block 2106, the method 2100 may include dividing the second winding path into a number, n, of sub-paths, where n>1 such that a resultant number of winding segments of the second winding path is greater than a resultant number of winding segments of the first winding path by a factor of n.

As shown in block 2108, the method 2100 may include connecting ends of the winding paths. Specifically, ends of the second winding path may be connected to an outermost sub-path of the number of sub-paths. Also, ends of the first winding path may be connected to an outermost winding segment of the first winding path in one of two conductive layers of the balun transformer.

As shown in block 2110, the method 2100 may include connecting ends of one or more sub-paths adjacent to the outermost sub-path to one another such that the second winding path maintains a continuous path between the ends of the second winding path.

As shown in block 2112, the method 2100 may include connecting a center tap to a sub-path that is adjacent to the outermost sub-path through one of the two conductive layers of the balun transformer.

As shown in block 2114, the method 2100 may include connecting one or more connectors using a via that bridges the two conductive layers of the balun transformer.

As shown in block 2116, the method 2100 may include forming a first winding following the first winding path in one or more of a first metal layer and a second metal layer of the balun transformer, and forming a second winding following the second winding path in one or more of the first metal layer and the second metal layer of the balun transformer, where each of the first winding and the second winding form independent electrically conductive paths in the balun transformer.

While some of the balun transformers described herein are designed by (i) laying out winding paths, (ii) dividing one or more of the winding paths into sub-windings, and (iii) forming conductive windings within one or more metal layers following the winding paths, other techniques are also or instead possible for designing or forming balun transformers. For example, a balun transformer may include forming windings outright in the described patterns within one or more metal layers on a substrate. In this manner, a balun transformer may include a first metal layer and a second metal layer disposed co-planar to one another on a substrate, as well as a first winding and a second winding formed in one or more of the first metal layer and the second metal layer.

The first winding may follow a first electrically conductive path between a first end and a second end thereof. The first winding may include a plurality of first winding segments each disposed around a central axis of the balun transformer, and a plurality of first connectors, where each of the plurality of first connectors joins adjacent first winding segments such that the first electrically conductive path is continuous between the first end and the second end.

The second winding may be formed in one or more of the first metal layer and the second metal layer as discussed above, where the second winding follows a second electrically conductive path between a third end and a fourth end thereof. The second electrically conductive path may be at least partly interwoven with, but independent from, the first electrically conductive path. The second winding may include a plurality of second winding segments each disposed around the central axis, where a number of the plurality of second winding segments is greater than a number of the plurality of first winding segments. The second winding may also include a plurality of second connectors, where each of the plurality of second connectors joins adjacent second winding segments such that the second electrically conductive path is continuous between the third end and the fourth end. Further, the first electrically conductive path and the second electrically conductive path may form a resultant pattern that is substantially symmetrical relative to an axis intersecting the central axis of the balun transformer.

The balun transformer may also include a center tap disposed in one of the first metal layer or the second metal layer. The center tap may be connected to a second winding segment that is adjacent to an outermost second winding segment and that includes no connectors along at least one side of the balun transformer.

In certain implementations, the balun transformer includes only two metal layers—no more and no less. Thus, the balun transformer may include metal layers on a substrate consisting of a first metal layer and a second metal layer disposed co-planar to one another on the substrate.

The balun transformers described herein may be used for any purpose stated herein or otherwise known in the art. For example, balun transformers described herein may be used for wireless radios and the like.

The above systems, devices, methods, processes, and the like may be realized in hardware, software, or any combination of these suitable for a particular application. The hardware may include a general-purpose computer and/or dedicated computing device. This includes realization in one or more microprocessors, microcontrollers, embedded microcontrollers, programmable digital signal processors or other programmable devices or processing circuitry, along with internal and/or external memory. This may also, or instead, include one or more application specific integrated circuits, programmable gate arrays, programmable array logic components, or any other device or devices that may be configured to process electronic signals. It will further be appreciated that a realization of the processes or devices described above may include computer-executable code created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software. In another implementation, the methods may be embodied in systems that perform the steps thereof, and may be distributed across devices in a number of ways. At the same time, processing may be distributed across devices such as the various systems described above, or all of the functionality may be integrated into a dedicated, standalone device or other hardware. In another implementation, means for performing the steps associated with the processes described above may include any of the hardware and/or software described above. All such permutations and combinations are intended to fall within the scope of the present disclosure.

Embodiments disclosed herein may include computer program products comprising computer-executable code or computer-usable code that, when executing on one or more computing devices, performs any and/or all of the steps thereof. The code may be stored in a non-transitory fashion in a computer memory, which may be a memory from which the program executes (such as random-access memory associated with a processor), or a storage device such as a disk drive, flash memory or any other optical, electromagnetic, magnetic, infrared or other device or combination of devices. In another implementation, any of the systems and methods described above may be embodied in any suitable transmission or propagation medium carrying computer-executable code and/or any inputs or outputs from same.

It will be appreciated that the devices, systems, and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

The method steps of the implementations described herein are intended to include any suitable method of causing such method steps to be performed, consistent with the patentability of the following claims, unless a different meaning is expressly provided or otherwise clear from the context. So, for example performing the step of X includes any suitable method for causing another party such as a remote user, a remote processing resource (e.g., a server or cloud computer) or a machine to perform the step of X. Similarly, performing steps X, Y, and Z may include any method of directing or controlling any combination of such other individuals or resources to perform steps X, Y, and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It should further be appreciated that the methods above are provided by way of example. Absent an explicit indication to the contrary, the disclosed steps may be modified, supplemented, omitted, and/or re-ordered without departing from the scope of this disclosure.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the scope of this disclosure and are intended to form a part of the disclosure as defined by the following claims, which are to be interpreted in the broadest sense allowable by law.

The various representative embodiments, which have been described in detail herein, have been presented by way of example and not by way of limitation. It will be understood by those skilled in the art that various changes may be made in the form and details of the described embodiments resulting in equivalent embodiments that remain within the scope of the appended claims.

Accordingly, embodiments and features of the present disclosure are set out in the following numbered items:

1. A balanced-to-unbalanced (balun) transformer, comprising: a first metal layer and a second metal layer disposed co-planar to one another on a substrate; a first winding path formed between a first end and a second end, the first winding path comprising: a plurality of first winding segments each disposed around a central axis of the balun transformer; and a plurality of first connectors, where each of the plurality of first connectors joins adjacent first winding segments such that the first winding path is continuous between the first end and the second end; a second winding path formed between a third end and a fourth end, the second winding path at least partly interwoven with, but independent from, the first winding path, the second winding path comprising: a plurality of second winding segments each disposed around the central axis; and a plurality of second connectors, where each of the plurality of second connectors joins adjacent second winding segments such that the second winding path is continuous between the third end and the fourth end, and where the first winding path and the second winding path form a resultant pattern that is substantially symmetrical relative to an axis intersecting the central axis; a first winding formed in one or more of the first metal layer and the second metal layer, the first winding following the first winding path; and a second winding formed in one or more of the first metal layer and the second metal layer, the second winding following the second winding path, and the second winding comprising a number, n, of sub-windings, where n>1 such that a resultant number of second winding segments of the second winding is greater than a resultant number of first winding segments of the first winding by a factor of n.

2. The balun transformer of item 1, further comprising a center tap formed in one of the first metal layer or the second metal layer.

3. The balun transformer of item 2, where the center tap is connected to a second winding segment that is adjacent to an outermost second winding segment.

4. The balun transformer of item 1, where one or more second winding segments that are adjacent to an outermost second winding segment lacks a second connector along at least one side of the balun transformer such that the second winding forms an electrically conductive path continuous between the third end and the fourth end.

5. The balun transformer of item 1, where each of the first winding path and the second winding path is wound to an interior and then wound to an exterior of the resultant pattern.

6. The balun transformer of item 1, where each of the plurality of first connectors and second connectors crosses another one of either a first connector or a second connector in different metal layers such that connectors remain separate in such crossovers.

7. The balun transformer of item 6, further comprising a via connected to one or more of the first winding and the second winding, the via forming a bridge between metal layers such that connectors are disposed in a different metal layer when the connectors form a crossover.

8. The balun transformer of item 1, where the balun transformer includes no more than two metal layers.

9. The balun transformer of item 1, where a majority of each of the first winding and the second winding is formed in the first metal layer, and where at least fifty percent of connectors are formed in the second metal layer.

10. The balun transformer of item 1, where the first winding is a primary conductor, and the second winding is a secondary conductor in the balun transformer.

11. The balun transformer of item 1, where the first end and the second end are connected to an outermost first winding segment, and where the third end and the fourth end are connected to an outermost second winding segment.

12. The balun transformer of item 1, where the first end and the second end are disposed opposite the third end and the fourth end.

13. The balun transformer of item 1, where n is an even number.

14. The balun transformer of item 1, where one or more of the first winding segments and the second winding segments have a polygonal shape.

15. The balun transformer of item 1, where one or more of the first winding and the second winding is tapered.

16. A method for making a balanced-to-unbalanced (balun) transformer, comprising: interweaving a first winding path and a second winding path to form a resultant pattern that is substantially symmetrical relative to an axis intersecting a central axis of the balun transformer, the first winding path and the second winding path each continuous between ends thereof, each of the first winding path and the second winding path comprising a plurality of winding segments disposed around the central axis and crossovers between winding segments, the crossovers formed using a connector bridging two conductive layers of the balun transformer to maintain separation of the first winding path and the second winding path between the two conductive layers; dividing the second winding path into a number, n, of sub-paths, where n>1 such that a resultant number of winding segments of the second winding path is greater than a resultant number of winding segments of the first winding path by a factor of n, and where ends of the second winding path are connected to an outermost sub-path of the number of sub-paths; and connecting ends of one or more sub-paths adjacent to the outermost sub-path to one another such that the second winding path maintains a continuous path between the ends of the second winding path.

17. The method of item 16, further comprising forming a first winding following the first winding path in one or more of a first metal layer and a second metal layer of the balun transformer, and forming a second winding following the second winding path in one or more of the first metal layer and the second metal layer of the balun transformer, where each of the first winding and the second winding form independent electrically conductive paths in the balun transformer.

18. The method of item 16, further comprising connecting a center tap to a sub-path that is adjacent to the outermost sub-path through one of the two conductive layers.

19. A method for making a balanced-to-unbalanced (balun) transformer, comprising: arranging a plurality of shapes substantially concentrically with one another around a center axis; removing midsections of each of the shapes on a plurality of sides; connecting midsection ends of adjacent shapes to form a first winding path continuous between a first end and a second end disposed on a first side of an outermost shape, the first winding path traversing from the outermost shape to an innermost shape and back, where, when traversing in a first direction from the first end: each midsection end reached along the first direction connects to an opposing midsection end on an adjacent shape until the innermost shape is reached; a connection is formed across a midsection of the innermost shape; and when continuing to traverse in the first direction after the connection across the midsection of the innermost shape, each midsection end reached along the first direction connects to an opposing midsection end on an adjacent shape until the outermost shape is reached, leading to the second end; connecting midsection ends of adjacent shapes to form a second winding path continuous between a third end and a fourth end on a second side of the outermost shape that is opposite the first side, the second winding path traversing from the outermost shape to the innermost shape and back, where the second winding path is symmetrical to the first winding path; dividing the second winding path into a number, n, of sub-paths, where n>1 such that a resultant number of winding segments of the second winding path is greater than a resultant number of winding segments of the first winding path by a factor of n; and connecting ends of one or more sub-paths that are adjacent to the outermost shape on the second side such that the second winding path remains continuous between the third end and the fourth end.

20. The method of item 19, where a plurality of connections of midsections cross another connection of midsections but remain separate by being provided in a different conductive layer of the balun transformer.

What is claimed is:

1. A balanced-to-unbalanced (balun) transformer, comprising:

a first metal layer and a second metal layer disposed on a substrate;

a first winding path formed between a first end and a second end, the first winding path comprising:

a plurality of first winding segments; and a plurality of first connectors, where each of the plurality of first connectors joins adjacent first winding segments such that the first winding path is continuous between the first end and the second end and the combination of the plurality of first winding segments and the plurality of first connectors is disposed around a central axis of the balun transformer;

a second winding path formed between a third end and a fourth end, the second winding path at least partly interwoven with, but independent from, the first winding path, the second winding path comprising:

a plurality of second winding segments; and a plurality of second connectors, where each of the plurality of second connectors joins adjacent second winding segments such that the second winding path is continuous between the third end and the fourth end, the combination of the plurality of second winding segments and the plurality of second connectors is disposed around the central axis of the balun transformer, and where the first winding path and the second winding path form a resultant pattern that is substantially symmetrical relative to an axis intersecting the central axis;

a first winding formed in one or more of the first metal layer and the second metal layer, the first winding following the first winding path;

a second winding formed in one or more of the first metal layer and the second metal layer, the second winding following the second winding path, and the second winding comprising a number, n, of sub-windings, where n is a turns ratio and n>1 such that a resultant number of second winding segments of the second winding is greater than a resultant number of first winding segments of the first winding by a factor of n; and a center tap formed in one of the first metal layer or the second metal layer, connected to a second winding segment that is adjacent to an outermost second winding segment.

2. The balun transformer of claim 1, where one or more second winding segments that are adjacent to an outermost second winding segment lacks a second connector along at least one side of the balun transformer such that the second winding forms an electrically conductive path continuous between the third end and the fourth end.

3. The balun transformer of claim 1, where each of the first winding path and the second winding path is wound to an interior and then wound to an exterior of the resultant pattern.

4. The balun transformer of claim 1, where each of the plurality of first connectors and second connectors crosses another one of either a first connector or a second connector in different metal layers such that connectors remain separate in such crossovers.

5. The balun transformer of claim 4, further comprising a via connected to one or more of the first winding and the second winding, the via forming a bridge between metal layers such that connectors are disposed in a different metal layer when the connectors form a crossover.

6. The balun transformer of claim 1, where the balun transformer includes no more than two metal layers.

7. The balun transformer of claim 1, where a majority of each of the first winding and the second winding is formed in the first metal layer, and where at least fifty percent of connectors are formed in the second metal layer.

8. The balun transformer of claim 1, where the first winding is a primary conductor, and the second winding is a secondary conductor in the balun transformer.

9. The balun transformer of claim 1, where the first end and the second end are connected to an outermost first winding segment, and where the third end and the fourth end are connected to an outermost second winding segment.

10. The balun transformer of claim 1, where the first end and the second end are disposed opposite the third end and the fourth end.

11. The balun transformer of claim 1, where n is an even number.

12. The balun transformer of claim 1, where one or more of the first winding segments and the second winding segments have a polygonal shape.

13. The balun transformer of claim 1, where one or more of the first winding and the second winding is tapered.

* * * * *